US005915346A

United States Patent [19]

Rehr

[11] Patent Number: 5,915,346

[45] Date of Patent: Jun. 29, 1999

[54] COOLING CIRCUIT OF AN INTERNAL COMBUSTION ENGINE AND METHOD OF MAKING SAME

[75] Inventor: Antonius Rehr, Weissach, Germany

[73] Assignee: Dr. Ing. h.c.F. Porsche AG, Weissach, Germany

[21] Appl. No.: 08/889,196

[22] Filed: Jul. 8, 1997

[30] Foreign Application Priority Data

Jul. 17, 1996 [DE] Germany ..... 196 28 762

[51] Int. Cl.[6] ..... F02B 75/18

[52] U.S. Cl. ..... 123/41.74; 123/41.72; 123/41.82 R

[58] Field of Search ..... 123/41.72, 41.74, 123/41.82 R, 41.84

[56] References Cited

U.S. PATENT DOCUMENTS

| | | | |
|---|---|---|---|
| 2,713,332 | 7/1955 | Beardsley . | |
| 3,667,431 | 6/1972 | Kueny et al. | 123/41.72 |
| 4,284,037 | 8/1981 | Kasting et al. | 124/41.82 R |
| 4,312,304 | 1/1982 | Tyner | 123/41.74 |
| 4,346,676 | 8/1982 | Tyner | 123/41.82 R |
| 4,530,315 | 7/1985 | Mezger . | |
| 4,601,265 | 7/1986 | Wells et al. | 123/41.82 R |
| 4,729,347 | 3/1988 | Schmitz | 123/41.74 |
| 5,803,023 | 9/1998 | Takahashi et al. | 123/41.01 |

FOREIGN PATENT DOCUMENTS

| | | |
|---|---|---|
| 51 736 | 11/1966 | Germany . |
| 3326317A1 | 1/1985 | Germany . |
| 4015610A1 | 11/1990 | Germany . |
| 4001140C1 | 4/1991 | Germany . |
| 4322030A1 | 1/1995 | Germany . |
| 69206756T2 | 12/1995 | Germany . |

OTHER PUBLICATIONS

Search Report, Nov. 6, 1997, Europe.
Patent Office Communication, Mar. 13, 1997, Germany.

*Primary Examiner*—Noah P. Kamen
*Assistant Examiner*—Jason Benton
*Attorney, Agent, or Firm*—Evenson McKeown Edwards & Lenahan, PLLC

[57] ABSTRACT

Within the cooling circuit of an internal combustion engine, coolant ducts are connected in the cylinder head and the coolant jacket of the cylinder block with the coolant pump by coolant passages inside the cylinder block. Starting at the flange surface between the cylinder block and the cylinder head, ducts extend in the cylinder block that are connected with the main ducts of the cooling circuit and serve to supply or drain the cylinder head. These ducts are connected by cast slots that take their departure from the flange surface with the coolant jacket of the cylinder block. These cast slots permit a connection of the coolant jacket with the cooling circuit that is easy to produce without additional bores being necessary. In addition, using casting to produce the connection increases the reliability of the process.

19 Claims, 3 Drawing Sheets

COOLING CIRCUIT OF AN INTERNAL COMBUSTION ENGINE AND METHOD OF MAKING SAME

BACKGROUND AND SUMMARY OF THE INVENTION

This application claims the priority of German application 196 28 762.6 filed in Germany on Jul. 17, 1996, the disclosure of which is expressly incorporated by reference herein.

The invention relates to a cooling circuit of an internal combustion engine with a cast cylinder block with a coolant jacket, a cylinder head with coolant ducts, a common flange surface between the cylinder head and the cylinder block, as well as coolant passages inside the cylinder block that are designed as supply or return ducts, of which at least one coolant passage terminates in the flange area.

German Patent Document DE-43 22 030 A1 describes an internal combustion engine of the type referred to above in whose cooling circuit the coolant jacket of a cylinder block and the coolant ducts of a cylinder head are connected by coolant passages with a coolant pump. The coolant passages are located inside the cylinder block of the engine and designed as feed or return ducts. The coolant passages are partially in the form of bores in the cylinder block that terminate in a main duct of the coolant passage. These bores serve to supply the coolant ducts in the cylinder head. The problem with such a cooling circuit is the connection of the coolant jacket in the cylinder block to the main ducts by the bores. Since the main ducts are produced as part of the coolant passages in the cylinder block and are produced by casting, relatively large tolerances in terms of their position result, caused by changes in position between individual parts of the casting tool during the casting process. As a result of the differences in position of the cast parts of the coolant passage that fall within a range of tolerance governed by manufacturing, precise location of the bore with respect to the corresponding terminating area inside the coolant passage does not always result. Hence, sufficient processing reliability for mass production is not always achieved. Moreover the production of bores inside a cast cylinder block represents an additional time- and cost-intensive expense.

In addition, a cylinder block is known from U.S. Pat. No. 4,530,315 in which two rows of cylinders are arranged in the shape of a V. The coolant feed to the coolant jackets inside the cylinder blocks is performed by a lengthwise duct integrated into the base of the V formed by the cylinders. The connection of the lengthwise ducts of the cylinder blocks is made directly through relatively wide cast depressions.

On the other hand the invention is based on an object of improving a cooling circuit for such an internal combustion engine in such fashion that the connection between the coolant jacket inside the cylinder block and the coolant passages can be produced simply and reliably and is suitable for mass production. Areas that are especially important as far as flow technology is concerned (throttle points and transitions) should be possible to manufacture with a high level of precision as far as their position and assignment to individual parts of the cooling circuit are concerned. In addition, an adjustment of the through-flow volumes within the cooling circuit that is as simple as possible should be feasible.

This object is achieved according to the invention by providing an arrangement wherein a connection between the coolant jacket and at least one of the coolant passages is provided in the form of a slot starting at the flange area, which is cast into the cylinder block.

A connection of the coolant jacket inside the cylinder block, which is simple to manufacture and is reliable, with the sections of the coolant passages that are designed as supply or return ducts is obtained when this connection is in the form of a slot that starts in the flange area and is cast into the cylinder block. This slot, because of the fact that it is manufactured by casting, is precisely located and positioned and thus reliably produced by a suitable design of the casting tool. Deviations in the position of the cast coolant passage have no effect because of the tool-related direct shaping of the connection. In addition, a further workstep is avoided by using casting technology to make the connection, said step otherwise being necessary to produce a bore. In addition, in an especially advantageous manner, in the connection between the coolant jacket and the coolant passage that is produced by casting, adjustment of the coolant flow can be accomplished by the adapted geometry of the cast slot.

A high degree of accuracy in adjusting the coolant flow is achieved in an advantageous fashion if the depth of the slot connecting the coolant jacket and the coolant passage is greater than its width. Following the manufacture of the cast blank of the cylinder block, in a subsequent workstep the flange surface is machined with material removal. Because of the tolerances that result from manufacturing, the thickness of the amount to be removed from the flange surfaces differs from one part to the next. If during the production of the connecting slot its depth is made greater than its width, even with different removal rates, the influence on the cross sectional surface of the slot that is perpendicular to the flange surface is less than with a relatively wide design for the slot. The influence of the final machining of the cast blank on the cross sectional surface of the slot is minimized when the width B of the slot is reduced sufficiently to permit consistent manufacturing. In order to achieve a specific cross sectional area, therefore, the depth T of the slot is relatively great so that the influence of the removal rate in the final machining of the flange area is minimized.

The design of the cooling circuit and the production of the cylinder block of the internal combustion engine become especially simple and economical if the coolant jacket is connected both on the input and output sides in each case by at least one slot with the coolant passage (supply duct and return duct).

Uniform flow around the cylinder is achieved in an especially advantageous manner if the slot connected with the coolant jacket runs approximately radially with respect to the adjoining cylinder.

The flow through the coolant jacket is also made even more uniform if an input and an output slot are provided for each cylinder. Then in an especially simple fashion a transverse cooling flow can be formed within the cylinder block. This transverse cooling flow is very uniform if the slots on the input side and the output side are located diametrally opposite one another.

Especially in multicylinder internal combustion engines, in a particularly advantageous manner, an adjustment of the coolant flow can be accomplished if the slots connecting the coolant jacket and the coolant passages are adjusted geometrically so that their cross sections and therefore their depths in particular are dimensioned as a function of the pressure drop (distance from the coolant pump). By adjusting the geometry of all the slots, a uniform coolant stream can be obtained for each individual cylinder.

A coolant passage of this kind with cast slots for joining the coolant jacket and the coolant passages within the cylinder block is especially advantageously suitable for cylinder blocks made using the open-deck design.

Other objects, advantages and novel features of the present invention will become apparent from the following detailed description of the invention when considered in conjunction with the accompanying drawings.

DETAILED DESCRIPTION OF THE DRAWINGS

Figure 1:
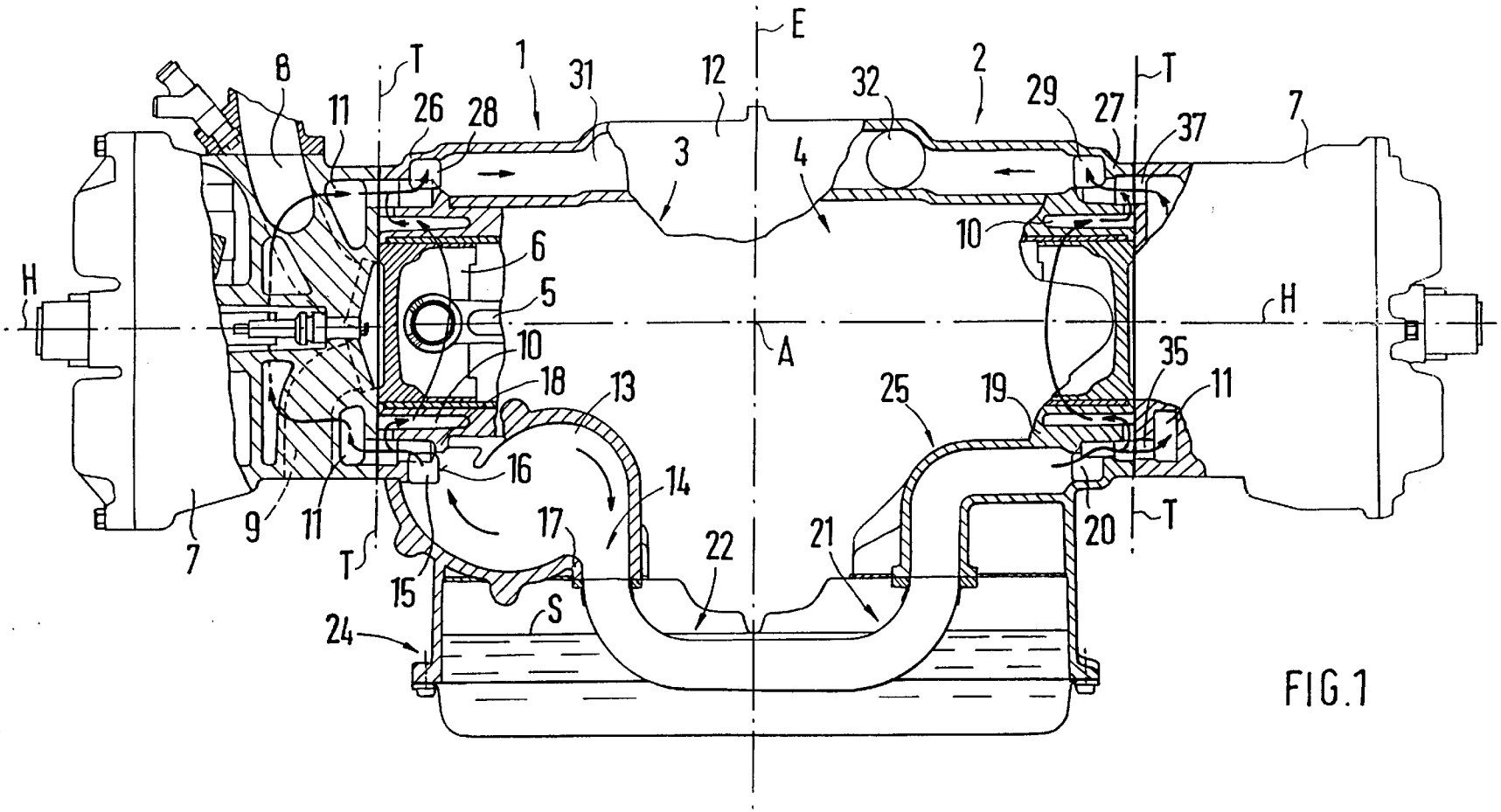
FIG. 1 shows a considerably simplified cross section through an internal combustion engine in the vicinity of one of its ends, constructed according to a preferred embodiment of the present invention.
Figure 2:
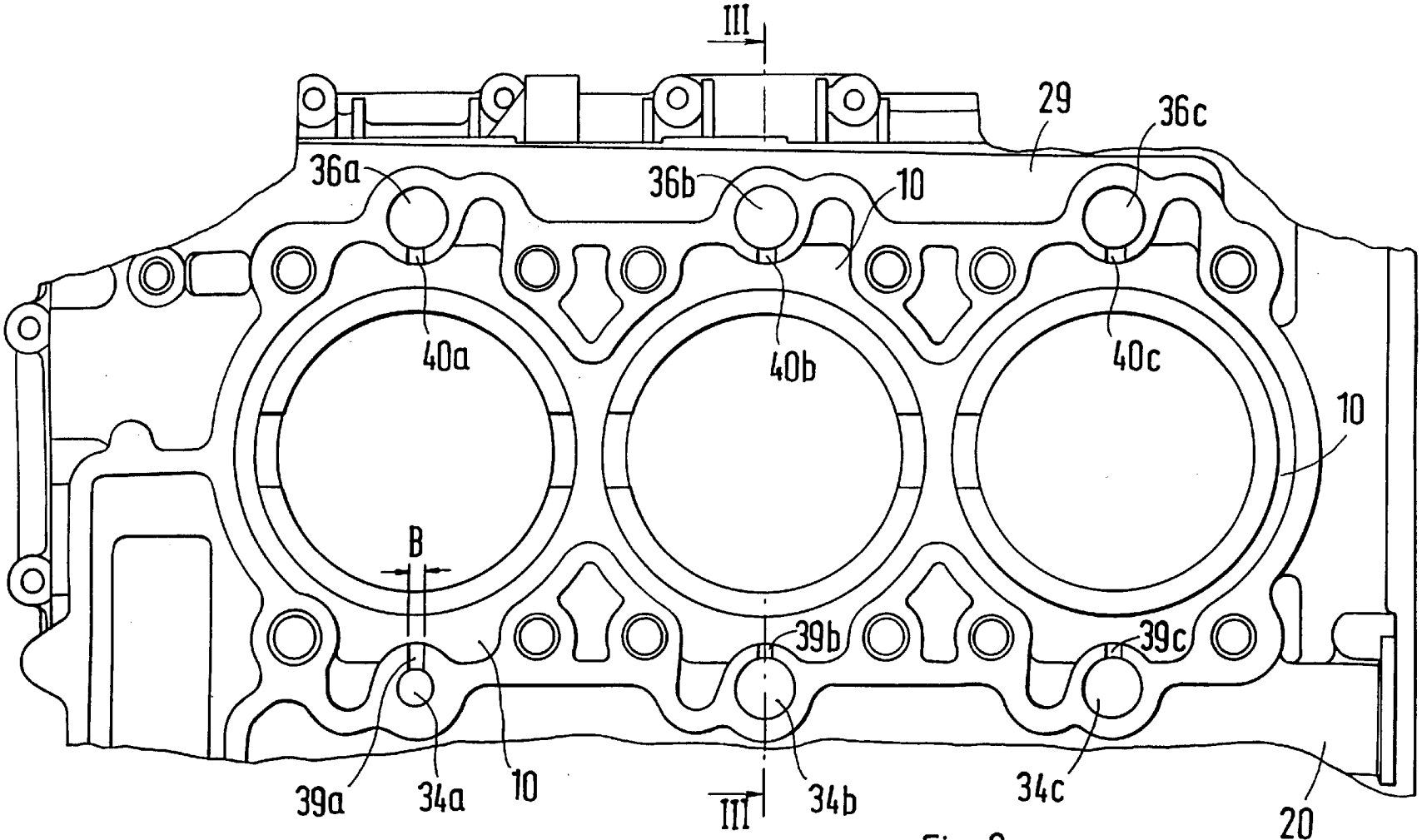
FIG. 2 is a top view of the flange surface of a cylinder block facing the cylinder head.
Figure 3:
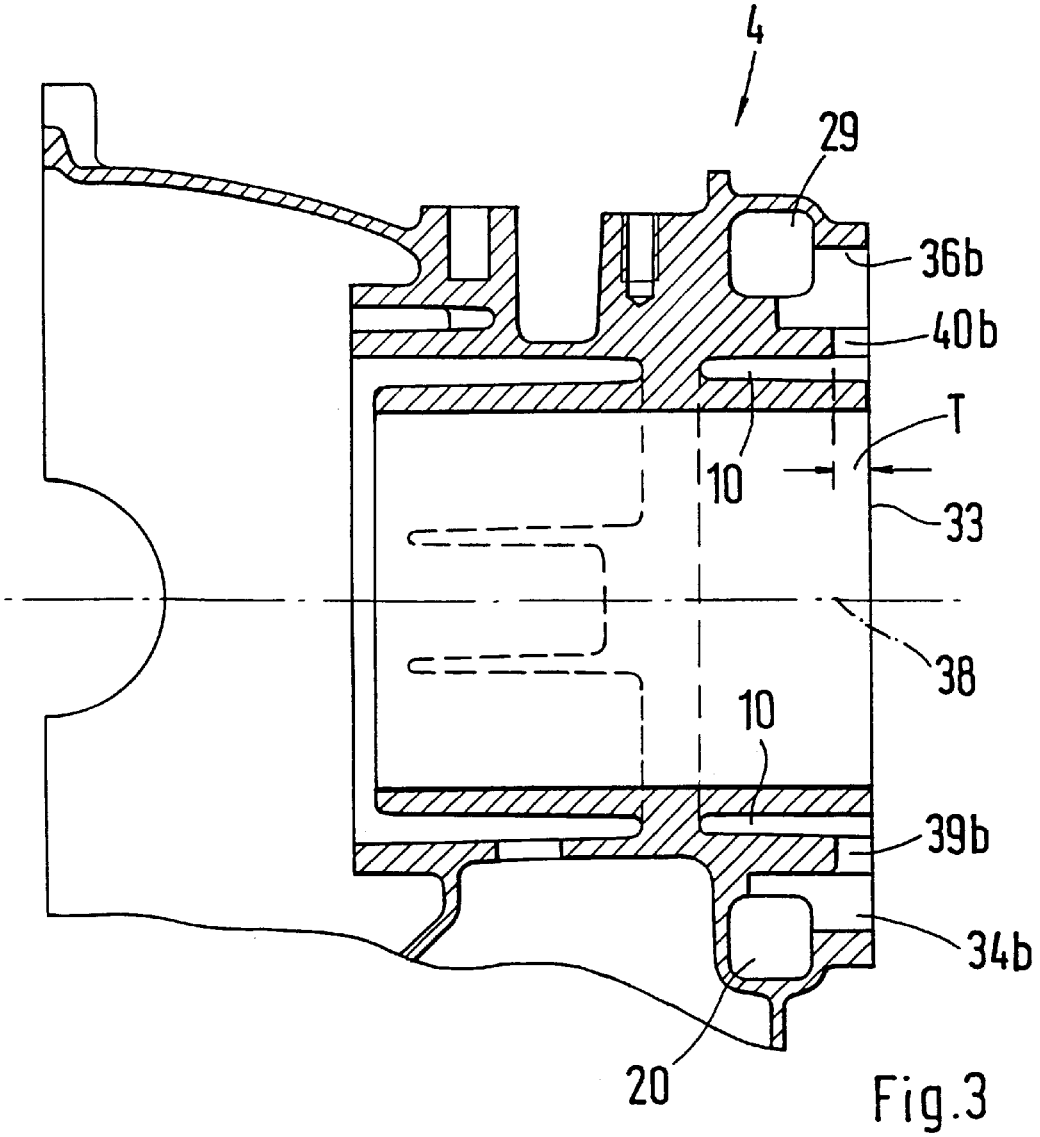
FIG. 3 is a section along III—III in FIG. 2.

The internal combustion engine shown in this embodiment has two rows of cylinders arranged in a V-angle of 180° and has a crankcase separated vertically along its parting plane E—E, with two halves 1, 2 that comprise cylinder blocks 3, 4. In this parting plane E—E there runs a lengthwise axis A which is simultaneously the rotational axis of a crankshaft, not shown. This crankshaft is connected by connecting rods 5 with pistons 6 which move in a horizontal plane H—H. Each row of cylinders is associated with a cylinder head 7 which is mounted in a parting plane T—T on one half of crankshaft housing 1 or 2 or on the respective cylinder block 3, 4. Cylinder heads 7 have intake and exhaust valves 8 and 9 equipped with gas exchange valves, not shown. The cylinder blocks of each row of cylinders have coolant jackets 10 and the cylinder heads 7 have coolant ducts 11.

On one end 12 of one cylinder block 3 there is a depression 13 to receive a coolant pump, not shown. This pump delivers coolant through two outflow openings 14 to rows of cylinders 1 and 2. One of these outflow openings 14 is made as an inlet opening 15 in a main supply duct 16 associated with row of cylinders 1. The other outflow opening is made in an outflow flange 17 directed downward. A second main supply duct 20 is associated with row of cylinders 2 at a distance from the coolant pump and is connected by a connecting duct 21 with outflow flange 17. The two main supply ducts run adjacent to each parting plane T—T below and parallel to lengthwise axis A in a lower wall 18, 19 of the respective cylinder block 3, 4. A section 22 of duct 21 is designed as a heat exchange tube 23 with cooling ribs, not shown in greater detail, on its outer jacket and passes through an oil pan 24 of the internal combustion engine. Heat exchange tube 23 bridges parting plane E—E and is connected at another section 25 of connecting duct 21 formed in lower wall 19.

Parallel to lengthwise axis A, corresponding main return ducts 28, 29 run in upper walls 26, 27 of crankshaft housing halves 1, 2 and/or cylinder blocks 3, 4, said ducts, as described below, being connected with the coolant jackets 10 of cylinder blocks 3, 4 and coolant ducts 11 of cylinder heads 7. In the vicinity of end 12 a collecting duct made as a cross duct 31 is located in walls 26, 27, said duct being connected by an outflow stub 32 with a water/air heat exchanger, not shown.

The main supply and main return ducts 16, 20 and 28, 29, cross duct 31, and section 25 of connecting duct 21 are cast into walls 18, 19, 26, and 27.

The remaining structure of the cooling circuit will be explained here for the sake of simplicity only using the example of the row of cylinders 2 shown at the right in FIG. 1. The part of the cooling circuit that is located in left row of cylinders 1 is designed analogously. In main supply duct 20, at each cylinder of the row of cylinders, a duct 34*a* to 34*c* that comes from flange surface 33 (parting plane T—T) terminates. These ducts 34*a* to 34*c* are made by casting and are cylindrical in this embodiment and serve to connect main supply duct 20 with coolant ducts 11 of cylinder head 7. Coolant ducts 11 of the cylinder head also have a cast feed section 35 for each cylinder, said section being connected in the vicinity of flange area 33 through a cylinder head gasket not shown with the associated ducts 34*a* to 34*c*, respectively. In main return duct 29, three cast ducts 36*a* to 36*c* terminate accordingly, coming from flange surface 33, said ducts being connected with coolant ducts 11 by return sections 37 in cylinder head 7. Ducts 34*a* to 34*c* as well as 36*a* to 36*c* extend at a distance from coolant jacket 10, in other words they are at a greater radial distance from cylinder axis 38 than the adjacent section of coolant jacket 10. Coolant jacket 10 is connected at each cylinder by a slot 39*a* to 39*c* with the respective ducts 34*a* to 34*c*. On the opposite side, coolant jacket 10 is connected by a corresponding slot 40*a* to 40*c* with one of ducts 36*a* to 36*c*. Slots 39*a* to 39*c* run from flange surface 33 and extend in the direction of cylinder axis 38 and, like ducts 34*a* to 34*c* and 36*a* to 36*c*, are made by the same casting process. Coolant jacket 10 in the vicinity of each cylinder is connected by slots 39*a* to 39*c* via ducts 34*a* to 34*c* with main supply duct 20 of the cooling circuit. On the opposite side, coolant jacket 10 is connected at each cylinder by slots 40*a* to 40*c* and ducts 36*a* to 36*c* with main return duct 29. During operation of the internal combustion engine, a cross flow can thus be created in the vicinity of the cylinder block.

To avoid throttle losses and turbulence, the inlet areas of slots 39*a* to 39*c* (on their respective sides facing ducts 34*a* to 34*c*) are rounded, in other words provided with inlet radii. In order to achieve a uniform division of the flow around the cylinders within the coolant jacket, slots 39*a* to 39*c* on the inlet side run radially with respect to the cylinder axis. In addition, for a further even division of the flow around the cylinders, the slots 40*a* to 40*c* on the output side are arranged diametrally with respect thereto and likewise run radially to the cylinder axis. The slots for each cylinder on the input side and output side are arranged for achieving uniform transverse flow cooling, and are opposite one another in the center of the cylinder, relative to the length of the cylinder block (in other words the line connecting them, not shown, runs at right angles to the length of the cylinder block).

During operation of the internal combustion engine, the coolant pump, not shown, delivers a stream of coolant in the direction indicated by the arrow in FIG. 1 through inlet opening 15 or connecting duct 21 into main supply ducts 16 and 20, from which the stream of coolant is divided at end 12 along axis A to the two rows of cylinders. The coolant ducts 11 of cylinder heads 7 are traversed by the flow through ducts 34*a* to 34*c* on the inlet side and ducts 36*a* to 36*c* on the outlet side. With suitable cross sectional dimensions of these ducts, the coolant stream can be adjusted. In this connection, the distance of the respective cylinder from the coolant pump must be taken particularly into account. The adjustment of the stream of coolant logically takes place uniformly either on the inflow side or the outflow side. The cross sections of each individual duct thus determine the size of the partial stream assigned to the respective cylinder. A uniform division of the partial flows per cylinder can thus be achieved by using cross sectional dimensions of the ducts that are adapted to the respective pressure losses. Advantageously, the adjustment of the partial flows per cylinder takes place on the inlet side since the tolerance-related deviations of the individual pressure losses at this point are still relatively small. The dimensions of the ducts on the outflow side are logically increased in order to reduce throttle losses.

Through slots 39*a* to 39*c*, a further partial flow is branched off from each partial flow of the water circuit, said partial flow serving to supply the respective section of coolant jacket 10. The flow cross section of the slot then determines the cylinder-related division of the coolant partial flow to the cylinder head on the one hand and the cylinder block on the other, while the flow cross section of the respective duct determines the cylinder-related total partial flow (cylinder head plus cylinder block). By a suitable adjustment of the flow cross sections of the respective slots, a fixed division of the cylinder-related partial flow to the cylinder head and cylinder block takes place. This division also takes place logically by adjusting the flow cross sections on the input side, in other words by a tuned dimensioning of the flow cross sections of slots 39*a* to 39*c*. The flow cross sections of slots 40*a* to 40*c* on the output side are made correspondingly larger in order to permit a return flow that is as throttle-free as possible.

In order to keep manufacturing-related tolerances as small as possible in dimensioning the flow cross sections of slots 39*a* to 39*c* and 40*a* to 40*c*, the slots are designed so that their depths T are greater than their widths B. The influence of the removal rate during the machining of flange area 33 can thus be kept low.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Cooling circuit of an internal combustion engine with a cast cylinder block with a coolant jacket, a cylinder head with coolant ducts, a common flange surface between the cylinder head and the cylinder block, as well as coolant passages inside the cylinder block that are designed as supply or return ducts, of which at least one coolant passage terminates in the flange area, wherein a connection between the coolant jacket and at least one of the coolant passages is provided in the form of a slot starting at the flange surface area, which is cast into the cylinder block.

2. Internal combustion engine according to claim 1, wherein a depth of the slot in a direction perpendicular to the flange surface is greater than a width transverse to the depth.

3. Cooling circuit of an internal combustion engine according to claim 1, wherein the coolant jacket is connected by at least one of said slots on the inlet side with a supply duct and by at least one of said slots on the outlet side with a return duct.

4. Cooling circuit of an internal combustion engine according to claim 1, wherein the slot extends approximately radially to a cylinder.

5. Cooling circuit of an internal combustion engine according to claim 3, wherein the depth of each of the slots in a direction perpendicular to the flange surface is greater than a width transverse to the depth.

6. Cooling circuit of an internal combustion engine according to claim 4, wherein the depth of each of the slots in a direction perpendicular to the flange surface is greater than a width transverse to the depth.

7. Cooling circuit of an internal combustion engine according to claim 1, wherein two of said slots cast into the cylinder block are provided for each engine cylinder, one being an input-side slot and the other being an output-side slot.

8. Cooling circuit of an internal combustion engine according to claim 7, wherein the input-side slots and output-side slots are located diametrally with respect to a respective associated cylinder.

9. Cooling circuit of an internal combustion engine according to claim 7, wherein the connecting lines between the input-side slots and output-side slots for each cylinder extend approximately at right angles to the length of the cylinder block.

10. Cooling circuit of an internal combustion engine according to claim 8, wherein the connecting lines between the input-side slots and output-side slots for each cylinder extend approximately at right angles to the length of the cylinder block.

11. Cooling circuit of an internal combustion engine according to claim 1, wherein at least two cylinders are arranged in line, wherein one input-side cast slot is provided for each cylinder, and wherein the depth of the input-side slots differs for different cylinders to adjust the coolant flow.

12. Cooling circuit of an internal combustion engine according to claim 1, wherein the cooling circuit has at least two cylinders arranged in a series, wherein one output-side slot is provided for each cylinder, and wherein that the depth of the out-put side slots is different for different cylinders to adjust the coolant flow.

13. Cooling circuit of an internal combustion engine according to claim 11, wherein the cooling circuit has at least two cylinders arranged in a series, wherein one output-side slot is provided for each cylinder, and wherein that the depth of the out-put side slots is different for different cylinders to adjust the coolant flow.

14. Cooling circuit of an internal combustion engine according to claim 1, wherein a plurality of said slots are provided, and wherein the slots located on one side of the cylinder block are each connected with a main duct extending in the lengthwise direction of the cylinder block.

15. Cooling circuit of an internal combustion engine according to claim 1, wherein a plurality of said slots are provided, and wherein the slots are provided on their sides facing away from the coolant jacket with at least one inlet radius.

16. Cooling circuit of an internal combustion engine according to claim 1, wherein the cylinder block is made with an open-deck design.

17. A method of making a cooling circuit of an internal combustion engine with a cast cylinder block with a coolant jacket, a cylinder head with coolant ducts, a common flange surface between the cylinder head and the cylinder block, as well as coolant passages inside the cylinder block that are designed as supply or return ducts, of which at least one coolant passage terminates in the flange surface area, said method comprising casting a slot at the flange surface area of the cylinder block when casting the cylinder block, said slot forming a connection between the coolant jacket and at least one of the coolant passages.

18. A method according to claim 17, wherein a depth of the slot in a direction perpendicular to the flange surface is greater than a width transverse to the depth.

19. A method according to claim 18, wherein the coolant jacket is connected by at least one of said slots on the inlet side with a supply duct and by at least one of said slots on the outlet side with a return duct.

* * * * *